US011193301B2

(12) United States Patent
Nam

(10) Patent No.: US 11,193,301 B2
(45) Date of Patent: Dec. 7, 2021

(54) ONE-TOUCH TENT FLYSHEET

(71) Applicant: IDOOGEN CO., LTD., Seoul (KR)

(72) Inventor: Woo Hyun Nam, Seoul (KR)

(73) Assignee: IDOOGEN CO., LTD., Seoul (KR)

( * ) Notice: Subject to any disclaimer, the term of this patent is extended or adjusted under 35 U.S.C. 154(b) by 0 days.

(21) Appl. No.: 17/046,421

(22) PCT Filed: Dec. 27, 2018

(86) PCT No.: PCT/KR2018/016722
§ 371 (c)(1),
(2) Date: Oct. 9, 2020

(87) PCT Pub. No.: WO2019/198906
PCT Pub. Date: Oct. 17, 2019

(65) Prior Publication Data

US 2021/0123262 A1 Apr. 29, 2021

(30) Foreign Application Priority Data

Apr. 12, 2018 (KR) ..... 10-2018-0042665

(51) Int. Cl.
*E04H 15/40* (2006.01)
*E04H 15/54* (2006.01)

(52) U.S. Cl.
CPC ..... *E04H 15/54* (2013.01); *E04H 15/405* (2013.01)

(58) Field of Classification Search
CPC ..... E04H 15/405; E04H 15/58
(Continued)

(56) References Cited

U.S. PATENT DOCUMENTS 2,961,802 A * 11/1960 Mongan ..... E04H 15/20 52/81.4
5,642,538 A * 7/1997 McAllister ..... A47D 13/063 5/97

(Continued)

FOREIGN PATENT DOCUMENTS

KR 20-0416808 Y1 5/2006
KR 10-2010-0130056 A 12/2010

(Continued)

OTHER PUBLICATIONS

International Search Report of corresponding PCT Application No. PCT/KR2018/016722—4 pages (dated Apr. 12, 2019).

*Primary Examiner* — Noah Chandler Hawk
(74) *Attorney, Agent, or Firm* — Knobbe Martens Olson & Bear LLP

(57) ABSTRACT

A one-touch tent flysheet having an edge portion is fixed to the ground in a state in which the one-touch tent flysheet covers a tent to protect the tent from an external environment, includes a waterproof cloth installed to cover the tent, a tunnel-type pole which is fixed to the waterproof cloth to allow the waterproof cloth to stand in the form of a tunnel when the flysheet is installed and which is formed in a ring shape and bent so that a pair of first points facing each other press against the ground and a pair of second points facing each other, which are at a right angle from the first points, are located at the highest height level, and a fastening member configured to connect and fix portions of the tent and the flysheet to allow the flysheet to be attached to or detached from the tent.

6 Claims, 5 Drawing Sheets

(58) Field of Classification Search
USPC ..... 135/126
See application file for complete search history.

(56) References Cited

U.S. PATENT DOCUMENTS

| | | | | |
|---|---|---|---|---|
| 6,109,281 | A * | 8/2000 | Lowenthal | E04H 15/003 135/117 |
| 6,851,136 | B2 * | 2/2005 | Brereton | A47D 9/005 135/126 |
| 7,225,822 | B1 * | 6/2007 | Zheng | E04H 15/40 135/117 |
| 7,302,957 | B2 * | 12/2007 | Ross | E04H 15/40 135/117 |
| 7,575,011 | B2 * | 8/2009 | Zheng | E04H 15/40 135/117 |
| 7,578,306 | B2 * | 8/2009 | Mettavant | E04H 15/40 135/126 |
| 8,453,664 | B2 * | 6/2013 | Parsons | E04H 15/40 135/127 |
| 10,968,658 | B2 * | 4/2021 | Furuland | A47D 9/005 |
| 2004/0255996 | A1 | 12/2004 | Ross | |
| 2012/0017957 | A1 | 1/2012 | Hill, Sr. | |

FOREIGN PATENT DOCUMENTS

| | | | |
|---|---|---|---|
| KR | 10-1105942 | B1 | 1/2012 |
| KR | 10-1168239 | B1 | 7/2012 |

* cited by examiner

ONE-TOUCH TENT FLYSHEET

TECHNICAL FIELD

The present invention relates to a one-touch tent flysheet that may be installed at an upper portion of a tent with a weak support force at the upper portion, such as a one-touch tent, and is waterproof, windproof, and capable of blocking cold air.

BACKGROUND ART

Generally, tents are products developed to enjoy camping outdoors, and there are various types of tents.

In general, tents are made using a waterproof cloth or the like to block wind and rain from the outside, and poles having an elastic force are connected to form a frame of the tent. Since the tents are developed for camping, portability is important. Therefore, the tents are configured so that all the components thereof may be folded in very small sizes and carried together.

The most commonly used tent is assembled by connecting a plurality of poles to support a waterproof cloth so that an inner space is formed. Then, portions of the tent are connected and fixed to the ground. This is the most typical type of tent.

In addition to such a basic tent, there are tents that may be used indoors or tents in the form of a mosquito net that are only used to keep bugs such as mosquitos away.

Here, all types of tents, regardless of whether the tent is for outdoors, indoors, or in the form of a mosquito net, are collectively referred to as "tent(s)."

It takes some time to separate all the components of a tent that was being carried, connect and assemble poles and the like, and then fix the tent to the ground. Of course, the sturdier the tent, the more time it takes to assemble the tent.

In addition to such a basic tent, there are so-called "one-touch tents." The term "one-touch tents" literally refers to tents having a configuration that allows a task of unfolding and setting up the tent and a task of folding the tent again to be performed promptly.

The one-touch tents are, of course, not as sturdy as the basic tent but have become a popular item due to various reasons such as for attempting to take a rest for a little while or for installing the tent indoors.

One-touch tents, which are currently widely used, are tents that are folded in a circle when folded and are automatically unfolded due to an elastic force of a flexible pole when thrown out of the case.

Meanwhile, in the case of a typical tent, generally, the tent is fixed and installed on the ground, and then the entire tent is covered with a so-called "flysheet," which is made of waterproof cloth, to protect the inside of the tent from wind, rain, and humidity. Portions of the flysheet are tied to a tree or the like in some cases, but when there is no tree, piles are driven into the ground along four sides of the flysheet to fix the flysheet. Here, in the case of a typical tent, since the poles are sturdy, the shape of the tent remains almost the same even when the flysheet is tightly installed.

However, when the flysheet is installed on the one-touch tent according to the related art, there is a problem in that, as the flexible pole is bent due to a force applied by the flysheet, the shape of the one-touch tent does not remain the same.

Further, in the case in which the flysheet is installed on the one-touch tent according to the related art, there is a problem in that it takes great effort to unfold and fix the flysheet and also to fold the flysheet.

DISCLOSURE

Technical Problem

A flysheet according to the present invention is a cloth that covers the roof of a tent and serves to prevent the tent from getting wet due to rain or snow, protect the tent from wind, and block cold air. Meanwhile, one-touch tents that are unfolded just by being thrown are a popular item due to their portability and ease of installation. For one-touch tent users who value ease of use, it has been inconvenient to carry and use a flysheet, which requires connecting a pole and fixing to the ground, together with the tent. Due to an installation method, volume, weight, or the like of the conventional flysheet, it has been difficult to carry the one-touch tent and the flysheet together, and thus, the one-touch tent has been mainly used when taking a rest for a little while or installing the tent indoors.

A one-touch tent flysheet, which has been devised to address the above drawbacks, has the advantages of the one-touch tent and thus may be installed promptly and allow waterproof and warmth-keeping functions to be promptly provided to the one-touch tent using one touch. Also, the one-touch tent flysheet may be folded in the same shape as the one-touch tent and simultaneously stored therewith. Thus, the one-touch tent flysheet has portability.

The "one-touch flysheet" concept has been adopted to the one-touch tent for the first time to improve a sense of unity between the flysheet and the one-touch tent, and a method has been devised to allow the flysheet to be a pop-up type flysheet and to be promptly installed so that time taken to install the flysheet is reduced as compared to the related art.

The present invention is directed to providing a one-touch tent flysheet that includes a flexible pole so that, even when the flysheet is coupled to a one-touch tent while the one-touch tent is unfolded, the shape of the one-touch tent remains the same without being changed.

Technical Solution

According to the present invention, a one-touch tent flysheet, of which an edge portion is fixed to the ground in a state in which the one-touch tent flysheet covers a tent to protect the tent from an external environment, includes a waterproof cloth installed to cover the tent, a tunnel-type pole which is fixed to the waterproof cloth to allow the waterproof cloth to stand in the form of a tunnel when the flysheet is installed and which is formed in a ring shape and bent so that a pair of first points facing each other press against the ground and a pair of second points facing each other, which are at a right angle from the first points, are located at the highest height level, and a fastening member configured to connect and fix portions of the tent and the flysheet to allow the flysheet to be attached to or detached from the tent.

The fastening member may fix the pair of first points to the tent.

The one-touch tent flysheet may further include a fixing pin configured to fix an edge of the waterproof cloth to the ground.

The waterproof cloth may be cut out so that inlet portions for the tunnel-type pole are formed at a front surface portion at a center and side surface portions on both sides of the front surface portion.

The front surface portion may be rolled up and then fixed with a plurality of bands to remain rolled up.

Adjacent portions of the front surface portion and the side surface portions may be installed to be attachable to and detachable from each other by a hook-and-loop tape.

The tunnel-type pole may be bent to have a ring shape in a plan view before being installed and to have a hemispherical shape in a front view after being installed.

The one-touch tent flysheet may further include a first wire configured to connect the pair of first points of the tunnel-type pole and a second wire configured to connect the pair of second points.

A sleeve through which the second wire passes may be formed between the pair of second points of the tunnel-type pole, and an auxiliary pole, of which a length is longer than a diameter of the tunnel-type pole, may be inserted into the sleeve.

Advantageous Effects

According to the present invention, there are the following effects.

(1) A flysheet according to the present invention is fixed to a tent with a weak support force, as with a one-touch tent, and to the ground in a state in which the flysheet stands without applying a force to the tent. In this way, the flysheet can protect the tent from an external environment.

(2) In the flysheet according to the present invention, a ring-shaped pole may be formed in the form of a tunnel at a front portion, and a one-touch tent may be inserted and fastened to the flysheet through the front portion thereof. In this way, the flysheet can be installed very easily.

(3) The flysheet according to the present invention allows the time taken to install the flysheet to be reduced and the process of installing the flysheet to be simplified as compared to the related art. In this way, waterproofing and warmth-keeping effects can be promptly provided to the tent.

MODES OF THE INVENTION

Figure 1:
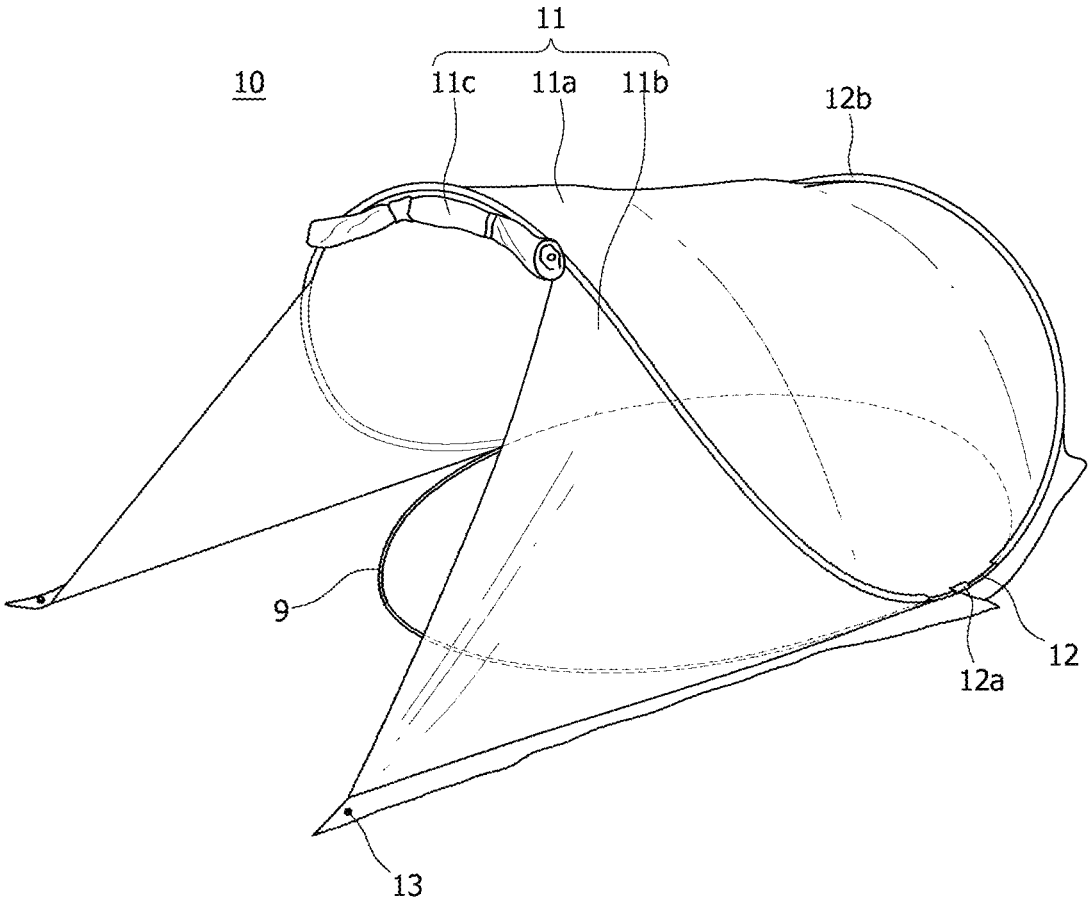
FIG. 1 is a perspective view illustrating a state in which only a one-touch tent flysheet according to the present invention is installed on the ground.

Hereinafter, embodiments of the present invention will be described in detail with reference to the accompanying drawings to allow those of ordinary skill in the art to which the present invention pertains to easily embody the present invention. The present invention may be implemented in various different forms and is not limited to the embodiments described herein. To clearly describe the present invention, parts that are irrelevant to the description have been omitted from the drawings, and the same or similar elements are denoted by the same reference numerals throughout.

In the application, terms such as "include" or "have" should be understood as designating that features, number, steps, operations, elements, parts, or combinations thereof exist and not as precluding the existence of or the possibility of adding one or more other features, numbers, steps, operations, elements, parts, or combinations thereof in advance. Also, in a case in which a portion, such as a layer, film, region, or plate, is mentioned as being "above" another portion, this not only includes a case in which the portion is "directly above" the other portion but also includes a case in which still another portion is present therebetween. Conversely, in a case in which a portion, such as a layer, film, region, or plate, is mentioned as being "below" another portion, this not only includes a case in which the portion is "directly below" the other portion but also includes a case in which still another portion is present therebetween.

Hereinafter, a one-touch tent flysheet according to an embodiment of the present invention will be described in more detail with reference to the accompanying drawings.

As illustrated in FIGS. 1 to 4, a one-touch tent flysheet 10 according to a first embodiment of the present invention, which is a flysheet of which an edge portion is fixed to the ground in a state in which the flysheet covers a tent 1 to protect the tent 1 from an external environment, includes a waterproof cloth 11, a tunnel-type pole 12, and a fastening member 20.

Referring to FIGS. 1 to 4, the waterproof cloth 11 is installed to cover the tent 1 and is made of a waterproof material like a typical flysheet.

Here, the one-touch tent flysheet 10 may further include a fixing pin 13 configured to fix an edge of the waterproof cloth 11 to the ground. That is, a plurality of holes are formed along the edge of the waterproof cloth 11, and the fixing pin 13 is inserted into each hole to fix the flysheet 10 to the ground.

Here, referring to FIGS. 1 to 4, the waterproof cloth 11 is cut out so that inlet portions for the tunnel-type pole 12 are formed at a front surface portion 11*c* at a center and side surface portions 11*b* on both sides of the front surface portion 11*c*. Therefore, when the waterproof cloth 11 is installed, the side surface portions 11*b* may be fixed to the ground using the fixing pin 13 at all times, and the front surface portion 11*c* may either be fixed or not fixed. Therefore, the front surface portion 11*c*, the side surface portions 11*b*, and a central portion 11*a* at an inner side of the tunnel-type pole 12 constitute the waterproof cloth 11.

Figure 2:
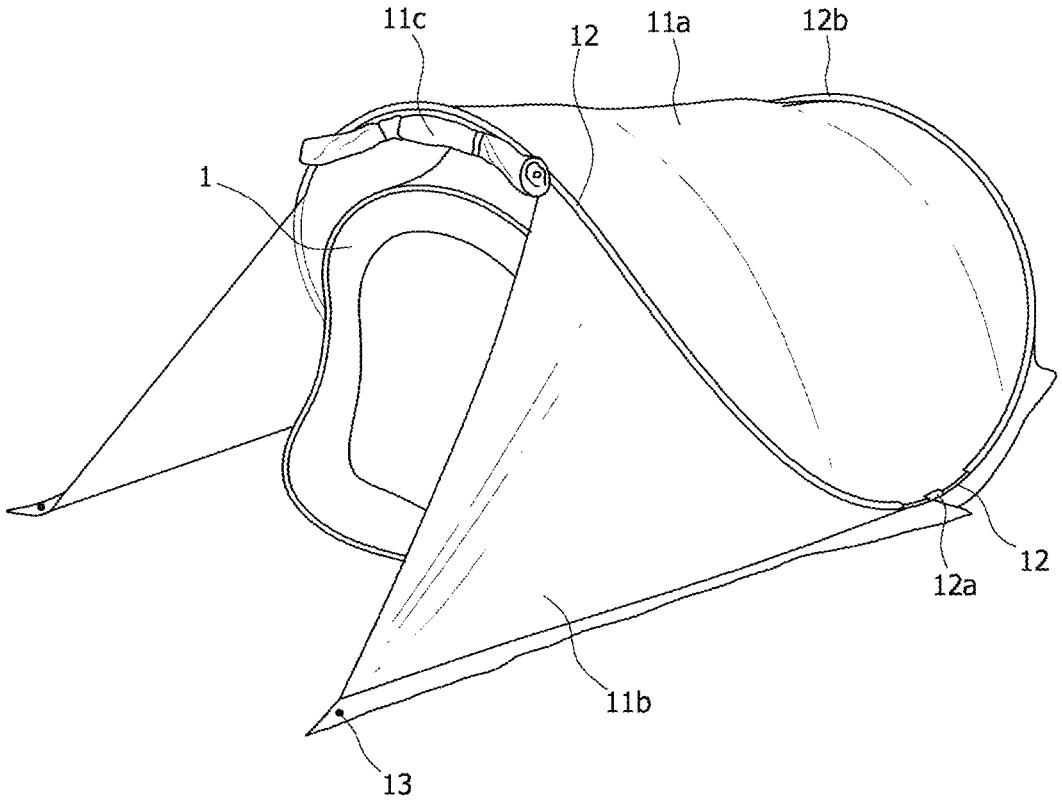
FIG. 2 is a perspective view illustrating a state in which the one-touch tent flysheet according to the present invention is installed on an upper portion of a tent.

Here, referring to FIGS. 1 and 2, the front surface portion 11*c* may be rolled up and then fixed with a plurality of bands to remain rolled up. In this way, an entrance to the one-touch tent 1 is secured.

Figure 3:
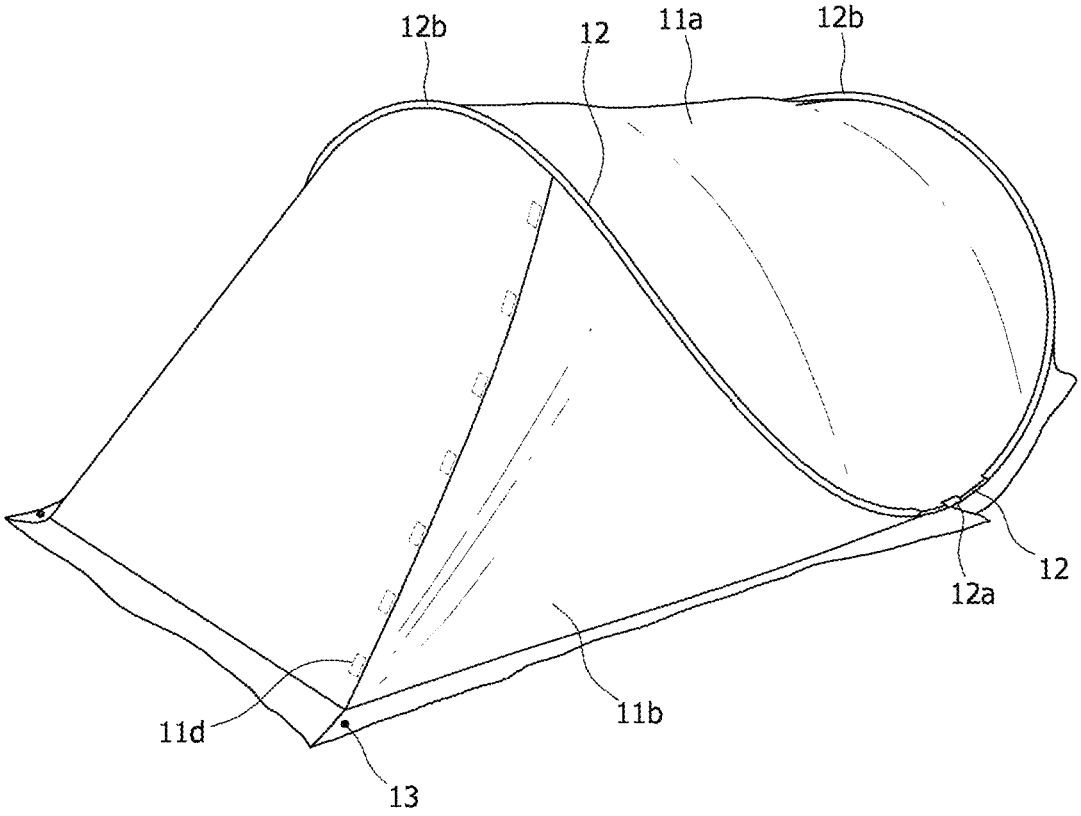
FIG. 3 is a perspective view illustrating a state in which a front cover of the one-touch tent flysheet illustrated in FIG. 2 is completely rolled down.

Here, referring to FIG. 3, adjacent portions of the front surface portion 11*c* and the side surface portions 11*b* may be installed to be attachable to and detachable from each other by a hook-and-loop tape 11*d*. Of course, a rope, a ribbon, or the like, other than the hook-and-loop tape 11*d*, may also be used for binding.

Referring to FIGS. 1 to 4, the tunnel-type pole 12 is fixed to the waterproof cloth 11 to allow the waterproof cloth 11 to stand in the form of a tunnel when the flysheet is installed.

Also, the tunnel-type pole 12 is formed in a ring shape and bent so that a pair of first points 12*a* facing each other press against the ground and a pair of second points 12*b* facing each other, which are at a right angle from the first points 12*a*, are located at the highest height level.

Here, the tunnel-type pole 12 may be bent to have a ring shape in a plan view before being installed and to have a hemispherical shape in a front view after being installed. Therefore, since the flysheet 10 is in a state of being unfolded in a ring shape in a plan view before and after being installed, the flysheet 10 may be folded like the one-touch tent and stored therewith.

Here, a portion of the tunnel-type pole 12 is inserted into a sleeve formed in the waterproof cloth 11, and another portion of the tunnel-type pole 12 is exposed to the outside. In particular, the pair of first points 12*a* are exposed and fastened to the one-touch tent 1.

Here, the tunnel-type pole 12 may be made of a metal material that is rigid and elastic so that the tunnel-type pole 12 may basically maintain its shape. Also, the tunnel-type pole 12 may be highly flexible like a pole of the one-touch tent 1 so that the tunnel-type pole 12 may be folded when a force is applied thereto. In this way, the flysheet 10 may be folded and stored together with the tent.

The fastening member 20 connects and fixes portions of the tent 1 and the flysheet 10 to allow the flysheet 10 to be attached to or detached from the tent 1.

Here, the fastening member 20 may fix the pair of first points 12*a* to the tent 1.

Figure 4:
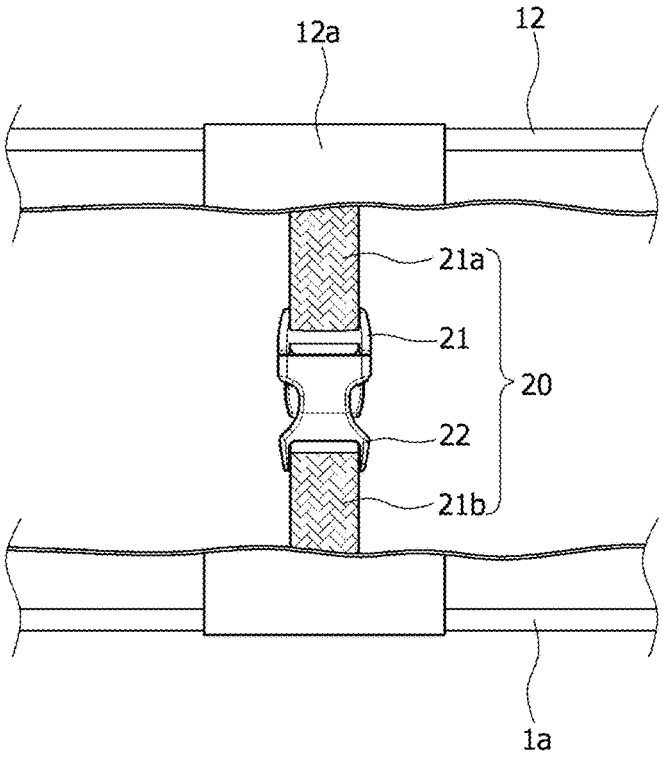
FIG. 4 is a front view of a fastener showing a state in which the one-touch tent flysheet according to the present invention is connected to the tent.

Here, referring to FIG. 4, a belt 21*a* and a fastener 21 are disposed at the pair of first points 12*a*, and a belt 21*b* and a fastener 22 are connected to a pole 1*a* and disposed in the tent 1 so that, by fastening the fasteners 21 and 22, the flysheet 10 may be fixed to the tent 1.

Of course, other than the fasteners 21 and 22 having the above-mentioned structure, fastening members such as a hook-and-loop tape, a ribbon, a string, or a wire may also be used to allow the flysheet 10 to be attached to or detached from the tent 1.

Referring to FIG. 1, it can be seen that, as a single product, only the flysheet 10 is fixed to a pad 9 such as a mat. The flysheet 10 is fixed to the ground by the fixing pin 13, and the front surface portion 11*c* at the center of the front surface of the flysheet 10 is rolled up and fixed in the vicinity of the tunnel-type pole 12. Also, the tunnel-type pole 12, which is originally in a circular ring shape, is fixed to both sides of the pad 9 by a fastening member and thus reaches and maintains a state of standing in the form of a tunnel.

Referring to FIG. 2, it can be seen that the one-touch tent 1 is installed in an inner portion of the flysheet 10. As illustrated, since the front surface portion 11*c* is open as illustrated in FIG. 1 and the entrance to the one-touch tent 1 is secured, and the flysheet is standing due to the tunnel-type pole 12, a force that may cause deformation of the one-touch tent 1 is not being applied thereto. In this state, when the tent 1 and the flysheet 10 are removed, since both the one-touch tent 1 and the flysheet 10 are folded in a disc shape, the one-touch tent 1 and the flysheet 10 may be folded and stored together in a single bag. Of course, installation of the tent 1 and the flysheet 10 may be performed the other way around. That is, when the stored one-touch tent 1 and flysheet 10 are taken out and unfolded, the tent 1 and the flysheet 10 are unfolded in their original shapes, the tent 1 and the flysheet 10 are fixed to each other using the fastening member 20 in a state in which an upper portion of the tent 1 is covered by the flysheet 10, and, at last, the flysheet 10 is fixed to the ground using the fixing pin 13.

Referring to FIG. 3, a state in which the one-touch tent 1, including the entrance to the one-touch tent 1, is completely covered is shown. That is, the front surface portion 11*c* is unfolded and coupled to the side surface portions 11*b* using the hook-and-loop tape 11*d*. In this way, a state is reached in which all four sides of the tent 1 may be protected by the waterproof cloth 11 of the flysheet 10.

Referring to FIG. 4, the fastening member 20 is illustrated. Since the belts 21*a* and 22*a* and the fasteners 21 and 22 are mounted on the tent 1 and the flysheet 10 and the fasteners 21 and 22 may be coupled to each other, the tent 1 and the flysheet 10 may be easily attached to or detached from each other. Here, since the pair of first points 12*a* at the lowest height level may be fastened, stable coupling is possible between the tent 1 and the flysheet 10.

Figure 5:
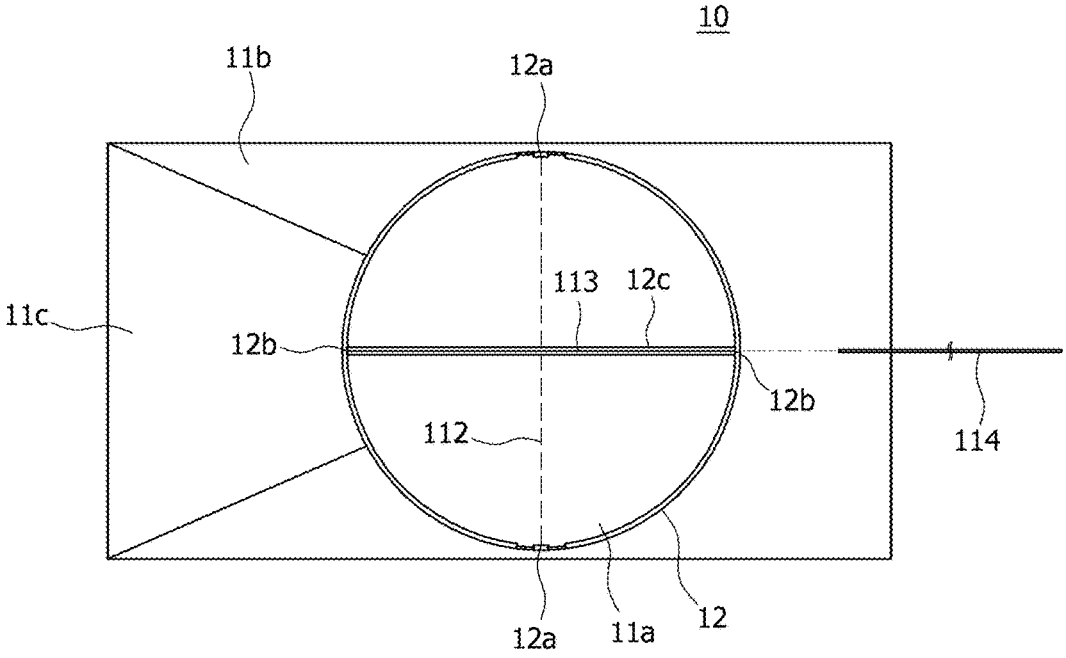
FIG. 5 is a plan view of a one-touch tent flysheet according to another embodiment of the present invention.

Meanwhile, referring to FIG. 5, a plan view of the flysheet 10 according to another embodiment of the present invention is illustrated. The flysheet 10 further includes, in addition to the elements thereof according to the previous embodiment, a first wire 112 configured to connect the pair of first points 12*a* of the tunnel-type pole 12, a second wire 113 configured to connect the pair of second points 12*b*, and a sleeve 12*c* disposed between the pair of second points 12*b* of the tunnel-type pole 12 and through which the second wire 113 passes, wherein an auxiliary pole 114, of which a length is longer than a diameter of the tunnel-type pole 12, is inserted into the sleeve 12*c*.

In this way, the first and second wires 112 and 113 minimize widening and deformation of the tunnel-type pole 12 due to an external force, and the auxiliary pole 114 prevents the flysheet from drooping as a whole and helps the height of the flysheet to be maintained.

Figure 6:
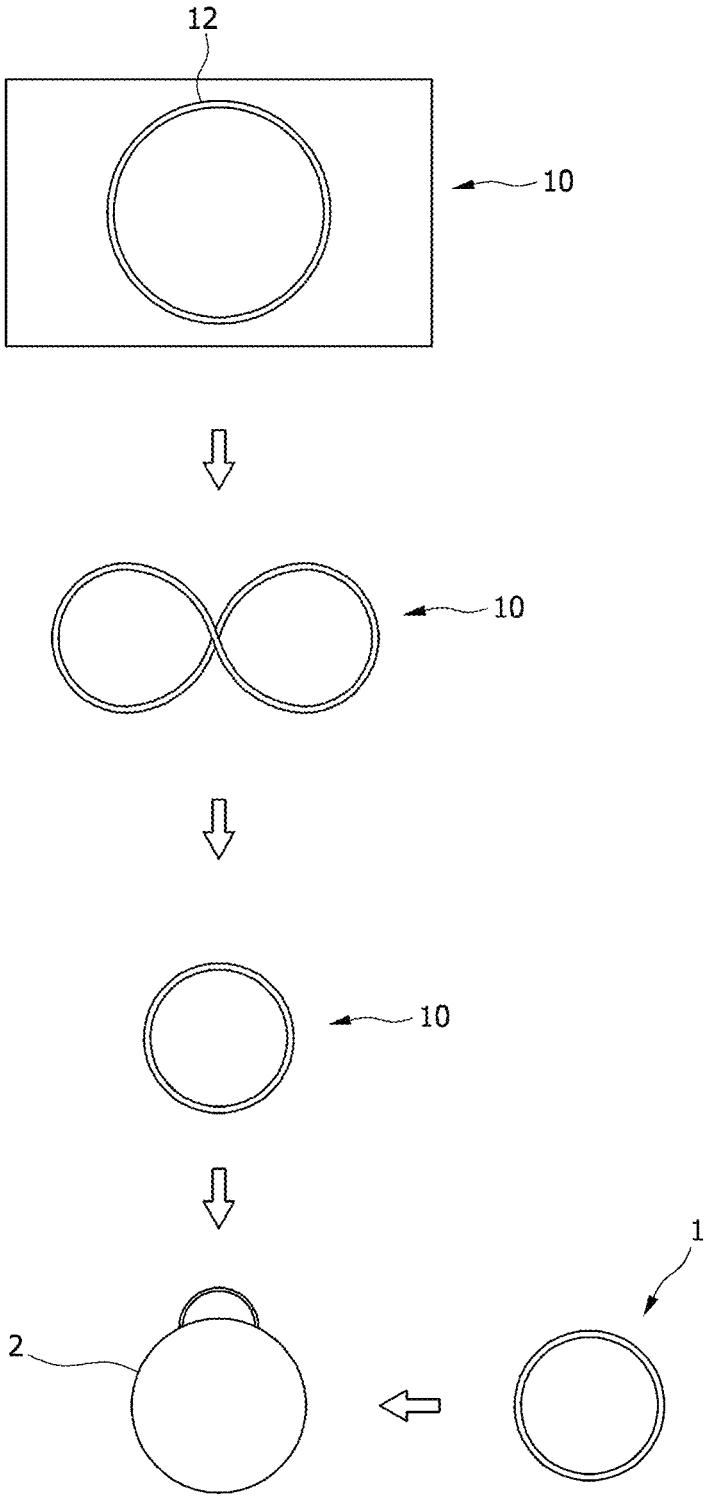
FIG. 6 is a schematic diagram of storing the flysheet and the tent according to the present invention.

Referring to FIG. 6, storing the flysheet 10 and the tent 1 together in a bag 2 is illustrated. First, the flysheet 10 may be folded properly and stored in the bag 2, and simultaneously, the tent 1 may also be folded and stored in the bag 2. In this way, since the flysheet 10 and the tent 1 may be stored and carried together, the flysheet 10 and the tent 1 may be prevented from being lost, and in particular, a case in which one forgets to bring the flysheet may be prevented.

The embodiments of the present invention have been described above, but the idea of the present invention is not limited to the embodiments proposed herein. Those who understand the idea of the present invention may easily propose other embodiments by addition, alteration, omission, and the like of elements, but the other elements also belong to the scope of the present invention.

INDUSTRIAL APPLICABILITY

The present invention may be widely applied to tents installed indoors and outdoors.

The invention claimed is:

1. A one-touch tent flysheet, of which an edge portion is fixed to the ground in a state in which the one-touch tent flysheet covers a tent to protect the tent from an external environment, the one-touch tent flysheet comprising:

a waterproof cloth installed to cover the tent;

a tunnel-type pole which is fixed to the waterproof cloth to allow the waterproof cloth to stand in the form of a tunnel when the flysheet is installed and which is formed in a ring shape and bent so that a pair of first points facing each other press against the ground and a pair of second points facing each other, which are at a right angle from the first points, are located at the highest height level; and a fastening member configured to connect and fix portions of the tent and the flysheet to allow the flysheet to be attached to or detached from the tent, wherein the waterproof cloth is cut out so that inlet portions for the tunnel-type pole are formed at a front surface portion at a center and side surface portions on both sides of the front surface portion, wherein the front surface portion is rolled up and fixed with a plurality of bands to remain rolled up.

2. The one-touch tent flysheet of claim 1, wherein the fastening member fixes the pair of first points to the tent.

3. The one-touch tent flysheet of claim 1, further comprising a fixing pin configured to fix an edge of the waterproof cloth to the ground.

4. The one-touch tent flysheet of claim 1, wherein adjacent portions of the front surface portion and the side surface portions are installed to be attachable to and detachable from each other by a hook-and-loop tape.

5. The one-touch tent flysheet of claim 1, wherein the tunnel-type pole is bent to have a ring shape in a plan view before being installed and to have a hemispherical shape in a front view after being installed.

6. A one-touch tent flysheet, of which an edge portion is fixed to the ground in a state in which the one-touch tent flysheet covers a tent to protect the tent from an external environment, the one-touch tent flysheet comprising:

a waterproof cloth installed to cover the tent;

a tunnel-type pole which is fixed to the waterproof cloth to allow the waterproof cloth to stand in the form of a tunnel when the flysheet is installed and which is formed in a ring shape and bent so that a pair of first points facing each other press against the ground and a pair of second points facing each other, which are at a right angle from the first points, are located at the highest height level; and a fastening member configured to connect and fix portions of the tent and the flysheet to allow the flysheet to be attached to or detached from the tent, a first wire configured to connect the pair of first points of the tunnel-type pole; and a second wire configured to connect the pair of second points, wherein a sleeve through which the second wire passes is formed between the pair of second points of the tunnel-type pole, and an auxiliary pole, of which a length is longer than a diameter of the tunnel-type pole, is inserted into the sleeve.

* * * * *